US007665453B1

(12) United States Patent
D'Agostino

(10) Patent No.: US 7,665,453 B1
(45) **Date of Patent: *Feb. 23, 2010**

(54) DISC LAUNCHING DEVICE

(76) Inventor: Robert D. D'Agostino, 19 Ellendale Rd., Attleboro, MA (US) 02703

( * ) Notice: Subject to any disclaimer, the term of this patent is extended or adjusted under 35 U.S.C. 154(b) by 296 days.

This patent is subject to a terminal disclaimer.

(21) Appl. No.: 11/416,868

(22) Filed: May 3, 2006

(51) Int. Cl.
*F41J 9/18* (2006.01)

(52) U.S. Cl. ..... 124/5; 473/505

(58) Field of Classification Search ..... 124/5; 473/505, 514

See application file for complete search history.

(56) References Cited

U.S. PATENT DOCUMENTS

| | | | | |
|---|---|---|---|---|
| 834,211 | A | 10/1906 | Linderman | |
| 934,093 | A | 9/1909 | North | |
| 1,186,098 | A * | 6/1916 | Horst | 124/5 |
| 1,700,880 | A * | 2/1929 | Camp | 124/5 |
| 2,122,984 | A * | 7/1938 | Loomis | 124/5 |
| 2,124,738 | A | 7/1938 | Johnsen | |
| 3,537,438 | A | 11/1970 | Reed | |
| 3,589,349 | A * | 6/1971 | Parker | 124/5 |
| 3,717,348 | A * | 2/1973 | Bowers | 473/514 |
| 3,901,208 | A | 8/1975 | Laporte et al. | |
| 3,970,307 | A * | 7/1976 | Breglia | 273/399 |
| 4,076,004 | A | 2/1978 | Huelskamp | |
| 4,364,371 | A * | 12/1982 | Woolard | 124/5 |
| 4,730,595 | A | 3/1988 | Glass et al. | |
| 4,789,161 | A * | 12/1988 | Waskelo | 473/514 |
| 4,984,556 | A | 1/1991 | Glass et al. | |
| 5,318,294 | A * | 6/1994 | Boroski | 473/505 |
| 5,522,597 | A * | 6/1996 | Hanks | 473/514 |

* cited by examiner

*Primary Examiner*—John Ricci
(74) *Attorney, Agent, or Firm*—Salter & Michaelson

(57) ABSTRACT

A game device adapted for use by a player to launch a disc or projectile. The holder has a pivot member with a rest position and a release position. The pivot member is biased to its rest position so as to at least partially retain the projectile in readiness for launching. A handle is attached to the holder for grasping by the player so as to launch the projectile.

25 Claims, 12 Drawing Sheets

DISC LAUNCHING DEVICE

TECHNICAL FIELD

The present invention relates in general to a game device or apparatus for launching a projectile such as a disc. The present invention can be implemented for the purpose of releasing a disc such as a Frisbee through the air. The present invention also relates to a novel game in which multiple players can use such a game device to throw a disc between players.

BACKGROUND OF THE INVENTION

A popular sport or game is "Frisbee" in which a plastic disk, that is typically a few inches in diameter, is thrown or sailed between players by a flip of the wrist. The disc is meant to be thrown manually. This limits the length and accuracy of the throw.

Accordingly, it is an object of the present invention to provide a game device or apparatus for use in the launching, propelling or throwing of a projectile such as a disc.

Another object of the present invention is to provide a novel disc throwing game in which multiple players can partake in throwing and catching discs thrown between players.

SUMMARY OF THE INVENTION

In accordance with one embodiment of the present invention there is provided a game device adapted for use by a player to launch a projectile, and comprised of, a holder for receiving the projectile, with the holder having a pivot member with a rest position and a released position, means for biasing the pivot member to its rest position so as to at least partially retain the projectile in readiness for launching, and a handle attached to the holder for grasping by the player so as to launch the projectile. Upon launch the pivot member, via engagement with the projectile, moves toward its released position to facilitate launching of the projectile.

In accordance with other aspects of the present invention the means for biasing may include at least one resilient band extending between the holder and pivot member; the means for biasing may include a spring extending between the holder and pivot member; the spring may comprise a coil spring; the spring may comprise a leaf spring; the holder may comprise an arcuate member having the pivot member hinged at one side and including an elongated arm at the other side; the holder may have a channel for receiving the projectile with the channel having a like cross-section matching the peripheral edge of the projectile; at least one roller may be provided that is rotatably supported at the distal end of the pivot member; a plurality of rollers may be supported adjacent to each other at the distal end of the pivot member; a pair of rollers may be pivotally supported at the distal end of the pivot member; the pivot member may have a channel forming a track for receiving one of an abrasive material and a gear surface; a post may be provided on either the holder or the pivot member for supporting the projectile and the projectile may have a first magnet means and the device a second magnet means to enable the projectile to be picked up by the device.

Another embodiment of the present invention is directed to a method of playing a throwing game that includes at least two players that each employ a game device adapted for use by the players to launch a disc that includes a holder for receiving the disc and retaining the projectile in readiness for launching. One player grasps the device and with a swing motion launches the disc. Upon launch another player catches the disc by means provided on the device. In this embodiment the disc may be a Frisbee and may further include post means on the device for receiving the thrown Frisbee. Attraction means may be provided on the device for assisting in picking up the thrown device.

In accordance with another embodiment of the present invention there is provided a game device that is adapted for use by at least one player to throw a projectile, and comprising, a holder for receiving the projectile and retaining the projectile in an initial position and in readiness for throwing, a handle attached to the holder for grasping by the player so as to launch the projectile, and a receiving post for catching a thrown projectile. The holder may have a pivot member with a rest position and a released position and means for biasing the pivot member to its rest position so as to at least partially retain the projectile in readiness for throwing. At least one roller may be provided that is rotatably supported at the distal end of the pivot member. A magnetic attraction means may be provided on the device for assisting in picking up the thrown projectile.

DESCRIPTION OF THE DRAWINGS

Numerous other objects, features and advantages of the present invention should now become apparent upon a reading of the following detailed description taken in conjunction with the accompanying drawings, in which.

DETAILED DESCRIPTION

Figure 1:
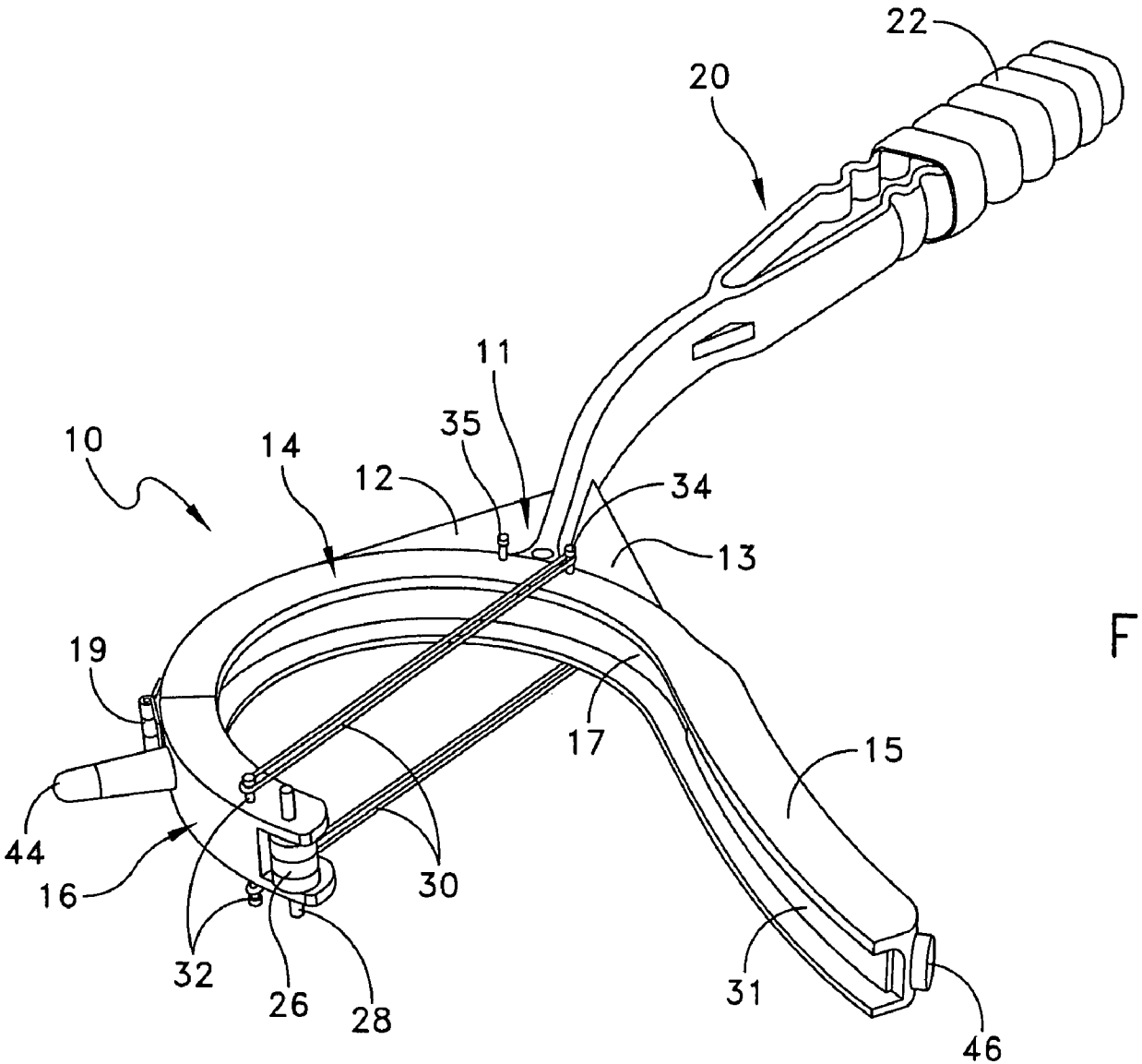
FIG. 1 is a perspective view of one embodiment of a disc launching device constructed in accordance with the principles of the present invention.
Figure 7:
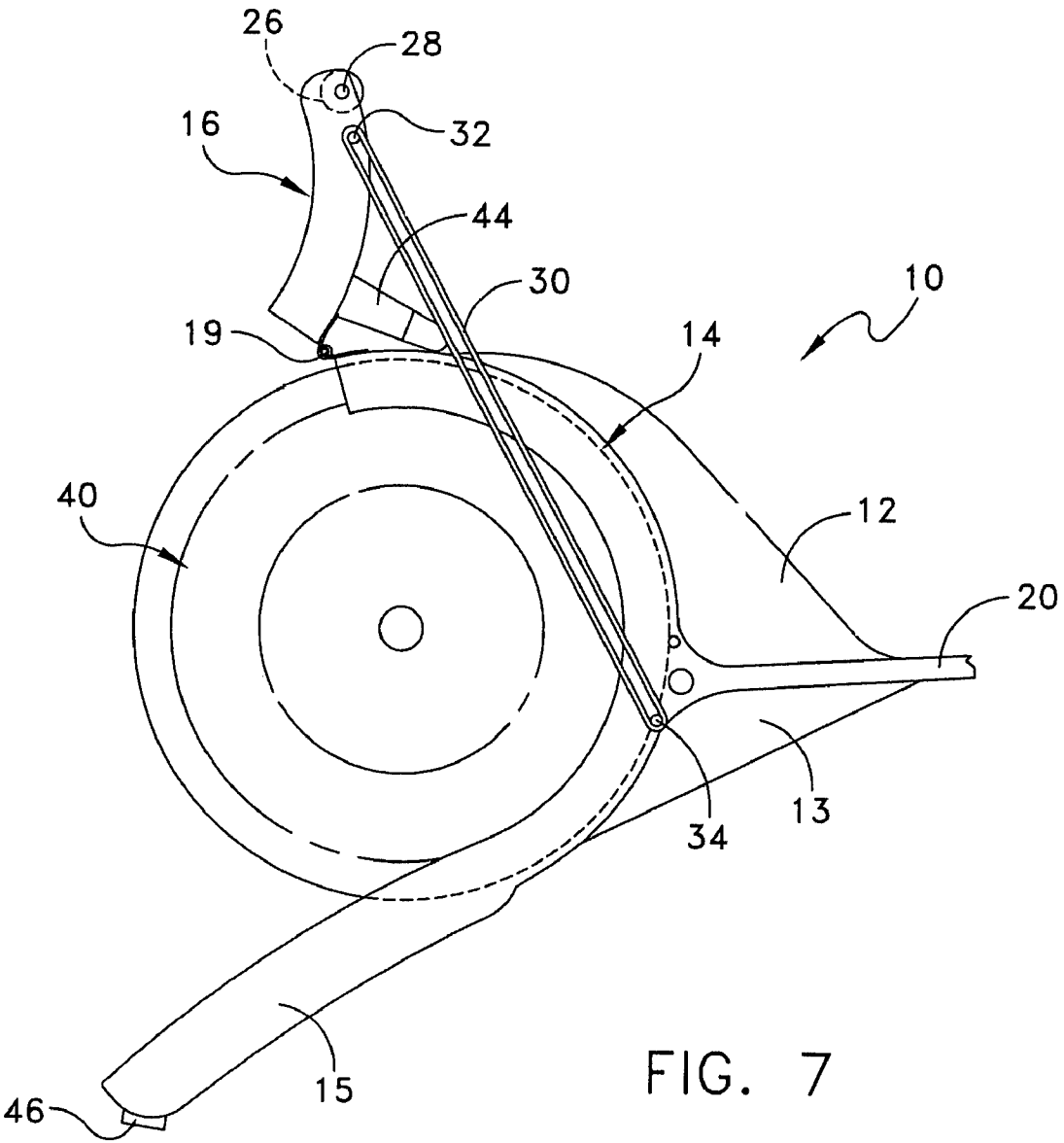
FIG. 7 is a plan view of the device of FIG. 1 with the pivot member opened.
Figure 8:
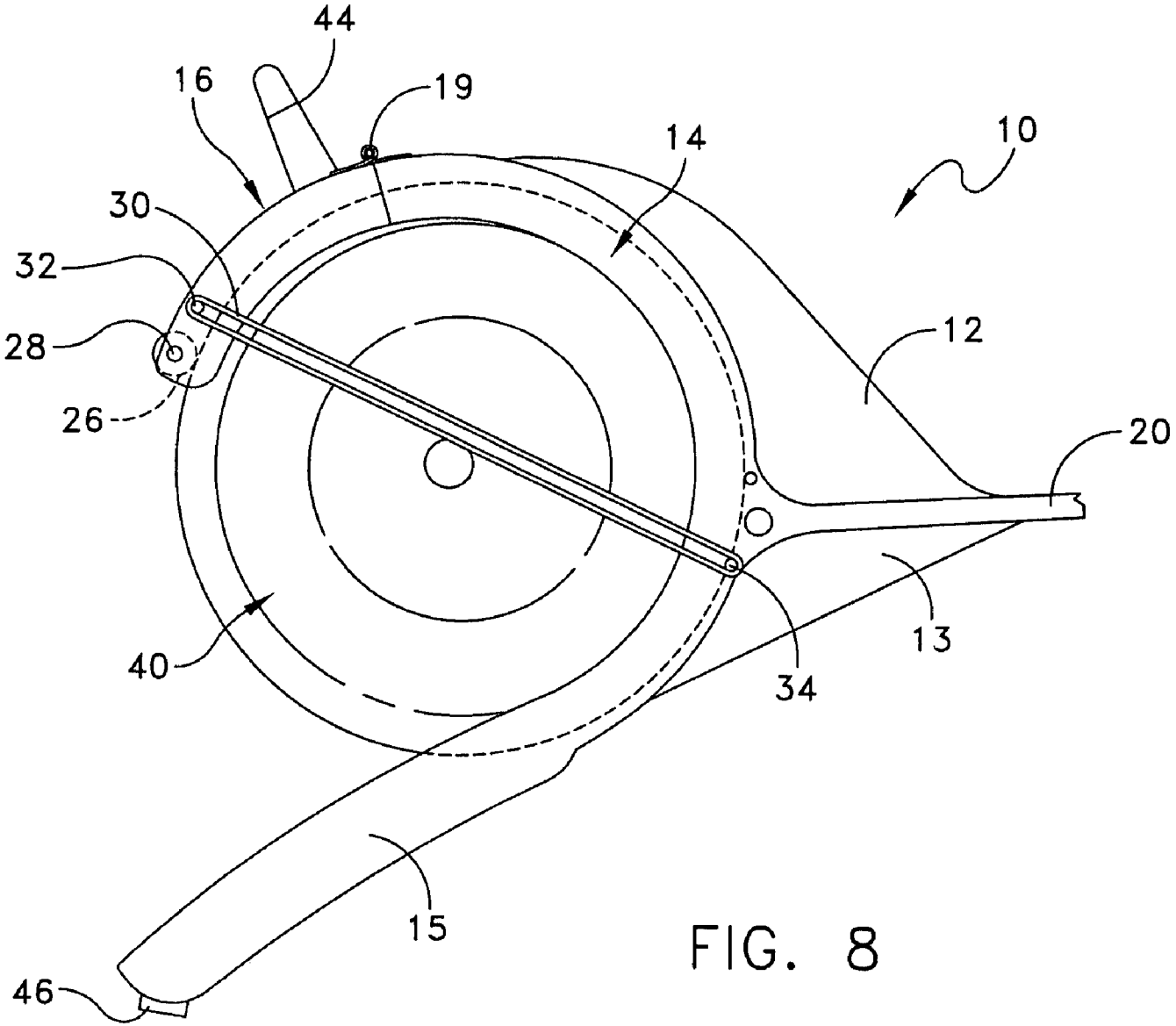
FIG. 8 is a plan view similar to that shown in FIG. 7 but with the pivot member closed about the disc or projectile.

Reference is now made to FIG. 1 for an illustration of a first embodiment of the present invention. The device or apparatus illustrated in FIG. 1 is considered as a game device that is adapted for use by a player or user to propel, launch or throw a disc. Different embodiments of the disc are shown in FIGS. 2-5. It is also understood that the device illustrated in FIG. 1 may be used for propelling or throwing a known disc-type device such as the well known "Frisbee." FIGS. 7 and 8 illustrate the disc or projectile in place in the launch device. FIG. 1 illustrates no disc in place.

Figure 6:
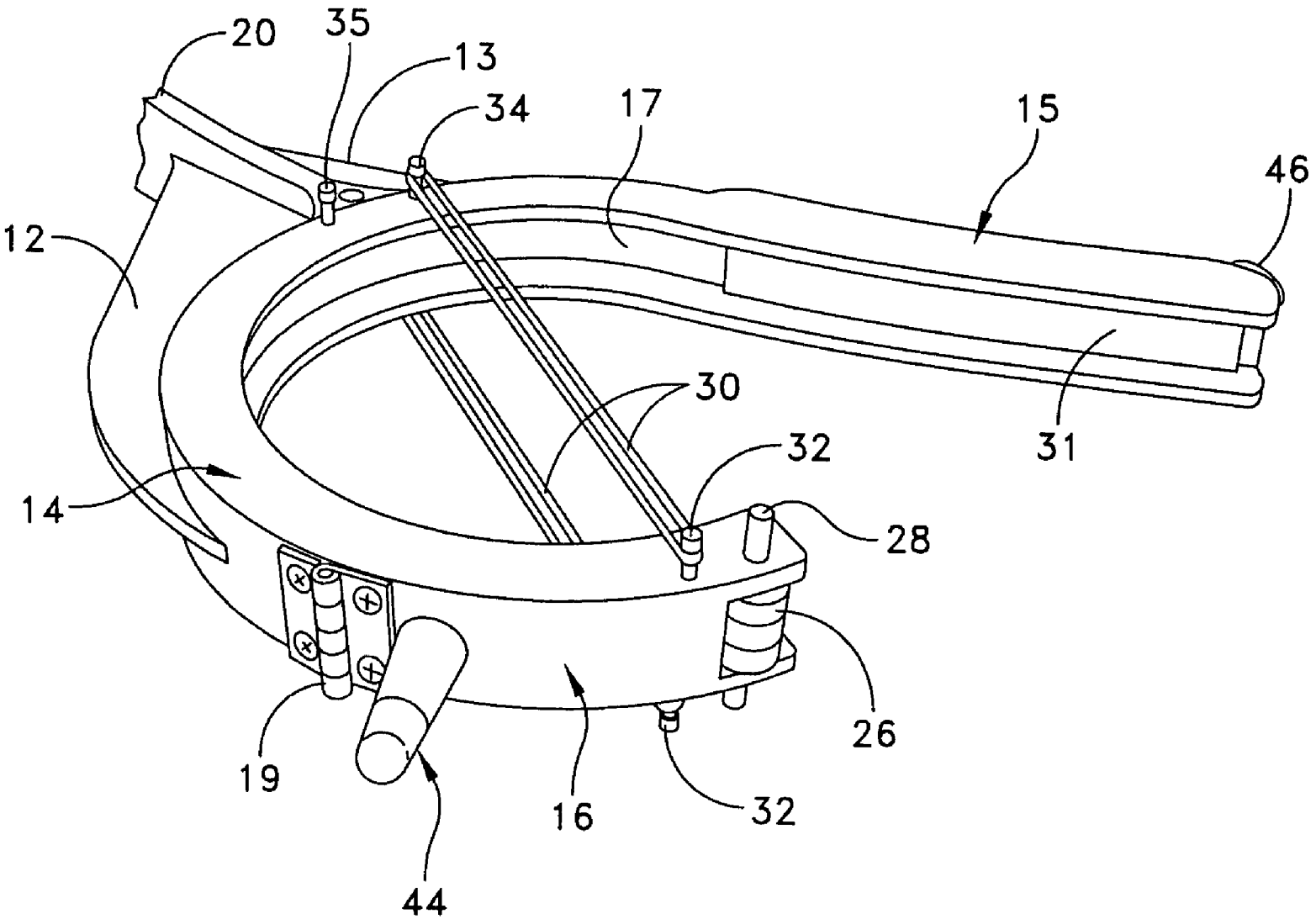
FIG. 6 is a fragmentary perspective view of a disc launching device illustrated in FIG. 1.

The disc launching device in FIG. 1 is comprised of two main components, namely, a holder 10 and a handle 20. The free end of the handle 20 may be provided with a rubber-like grip 22. The opposite end of the handle 20 connects to the holder 10 at 11. Because the handle 20 is meant to propel the disc by means of a swinging thereof the device may also be provided with reinforcing ribs 12 and 13 disposed respectively on either side of the handle 20 and connecting between the handle 20 and the holder 10 at the location 11. FIG. 6 also illustrates the manner in which, for example, the web 12 connects circumferentially about the holder 10.

As depicted in, for example, FIGS. 1 and 6, the holder 10 is defined by an arcuate or curve shaped base 14 having extending therefrom a tangential arm 15 on one side thereof and a pivotally connected pivot member 16 on the other side thereof. The curved base 10 and at least the pivot member 16 have a channel 17 in the form of a groove for receiving the projectile. FIGS. 1 and 6 do not illustrate the projectile in place, however, FIGS. 7 and 8 do illustrate the projectile or disc in place.

The pivot member 16 is connected to the curved base 10 by means of the pivot hinge 19. The pivot hinge 19 may be a conventional hinge secured on both sides to the respective curved base 10 and the pivot member 16. The pivot member 16 preferably also has an arcuate shape matching the radius of curvature of the curved base 10. The channel 17 also preferably extends into the pivot member 16.

In the first embodiment described herein, at the free end of the pivot member 16 there is supported a rotational roller 26 that is supported on a pivot pin 28. The ends of the pivot pin may also be used as support posts for an elastic spring means. In the first embodiment a single roller 26 is employed, while in a further embodiment described hereinafter, multiple rollers are employed.

The pivot member 16 is normally biased to its rest, closed or engaged position as illustrated in FIG. 1, 6 or 8 by means of elastic bands 30. To support these bands, there is provided a pair of pins 32 disposed respectively on top and bottom sides of the pivot member 16. The opposite end of the elastic band is supported on a pair of pivot pins 34 disposed on opposite upper and lower sides of the curved base 14. Additional pins 35 may also be used to change the position of the elastic bands and thus there amount of tension. The closer together that the pins 32 and 34 are, the less the tension provided by the elastic band 30. In an alternate embodiment only a single elastic band may be provided. In still another embodiment, multiple bands can be provided both on the top and bottom of the device.

The embodiment illustrated in FIGS. 1 and 6 is also characterized by further features. Preferably, the tangential arm 15 extends from the radius of the curved base 14 and may be provided with a slight reverse curve. The channel 17 extends into the arm 15. The arm 15 preferably also has an abrasive layer 31 secured in the channel or in a further groove in the channel. The layer 31 assists in the gripping of the disc 40 as it is being propelled from the disc launcher. The layer 31 may be attached by an adhesive and may have a sandpaper-like surface for contacting the disc.

Another feature disclosed in FIG. 1 is the use of a catch post 44. In this embodiment the catch post 44 is fastened to the outer surface of the pivot member 16. Alternatively, the catch post 44 could also be secured to an outer surface of the curved base 14 or the arm 15. FIG. 1 also illustrates the magnet 46 at the very free end of the arm 15. This can be used for picking up the disc, as will be described in further detail hereinafter.

Figure 2:
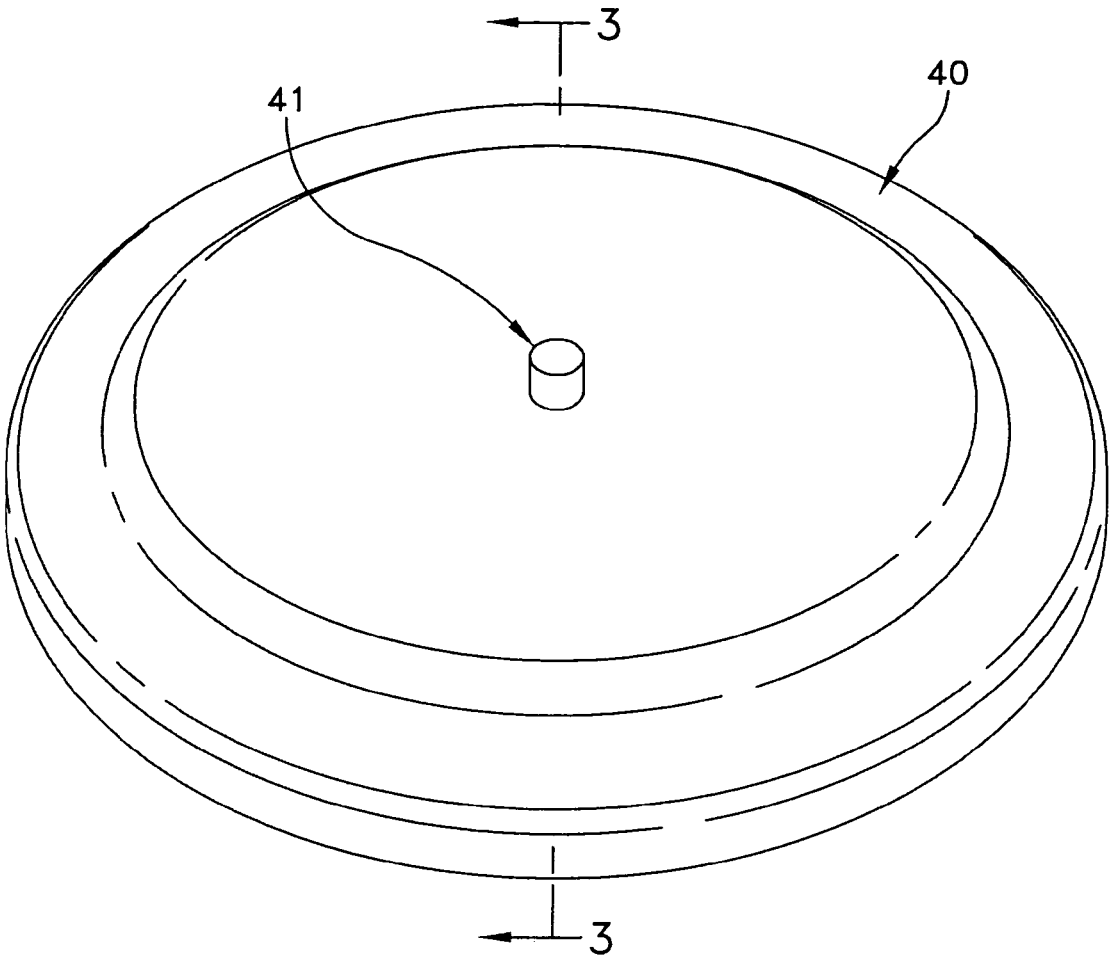
FIG. 2 is a perspective view of one embodiment of the disc or projectile constructed in accordance with the present invention.
Figure 3:
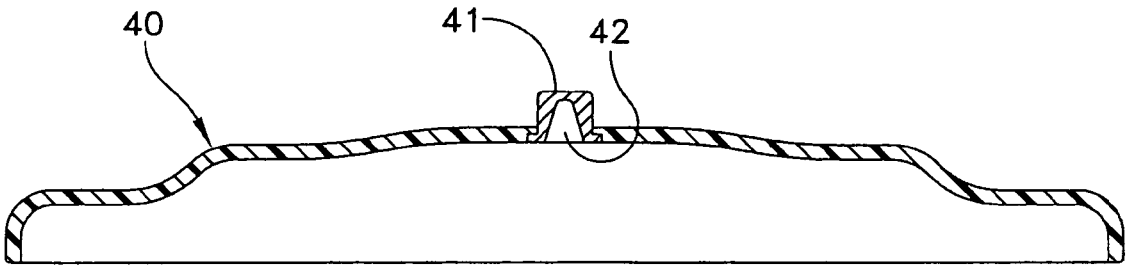
FIG. 3 is a cross-sectional view taken alone line 3-3 of FIG. 2.

A number of different types, shapes and configurations of discs or projectiles' may be launched with the device of the present invention. Some of these configurations are illustrated in FIGS. 2-5. FIGS. 2 and 3 illustrate a disc 40 that may have a cross-sectional configuration similar to a standard Frisbee. However, the disc, as illustrated in FIG. 3, is provided with a metallic tip 41 that defines a recess 42. The recess 42 is a catch recess enabling the frisbee to be caught at the catch post 44. The frisbee can also be picked up from the ground using the magnet 46 on the launcher which engages the metallic tip 41.

Figure 4:
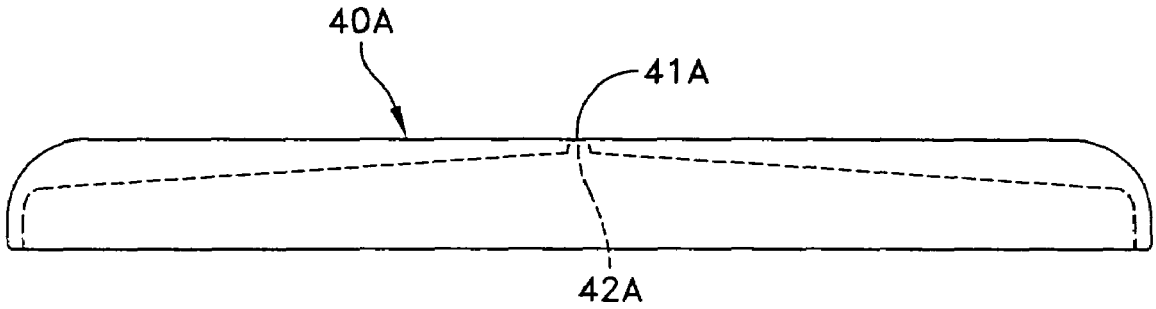
FIG. 4 is a side elevation view of an alternate embodiment of a disc or projectile.
Figure 5:
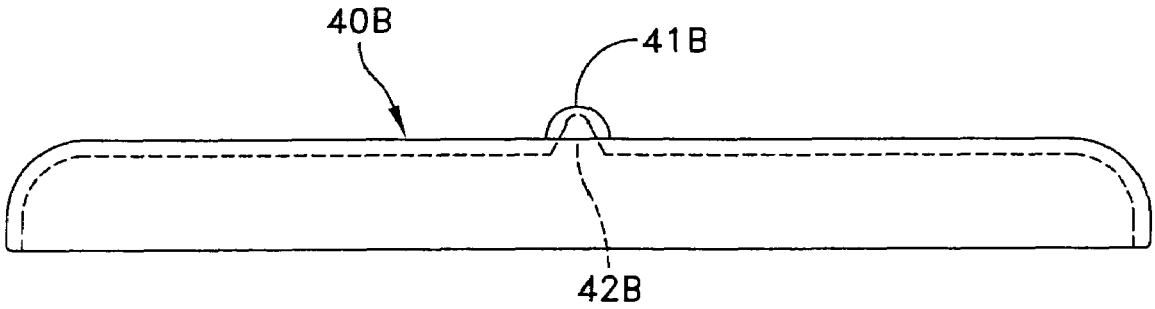
FIG. 5 is a side elevation view of still another embodiment of the disc or projectile.

FIG. 4 shows an alternate embodiment of a disc 40A with a tip 41A defining a recess 42A. Similarly, FIG. 5 is still a further version of the disc shown as disc 40B with tip 41B defining recess 42B. In both the discs of FIGS. 4 and 5 the tip may be metallic.

Reference is now made to the plan view of FIG. 7 for an illustration of the manner in which the pivot member 16 is pivoted at hinge 19 to an open position enabling ready insertion of the disc 40 into the curved base 14. In this position, the pivot member 16 pivots to a position wherein the post 44 forms a stop against the outer surface of the curved base 14. FIG. 7 also illustrates the tensioning band 30 that may maintain the pivot member in the illustrated position. The disc 40 can also be inserted with the pivot member closed by engaging the roller 26 and forcing the disc into the holder against the bias of the spring means.

Reference is now made to FIG. 8 that illustrates the pivot member 16 now being pivoted to its closed and engaged position. In that position, the elastic band 30 provides a limited amount of force, biasing the pivot member 16 into contact with the disc 40. Once the disc is in the position illustrated in FIG. 8, the launch device is ready for use. The disc is launched by the user or player grasping the handle 20 at the grip 22 and with a circumferential motion sweeping the device in an arc. The disc is propelled from the launch device under centrifugal force and is assisted by engagement with the roughed surface 31 as the disc is propelled out of the curved base past the pivot member and along the tangentially extending arm 15.

Figure 10:
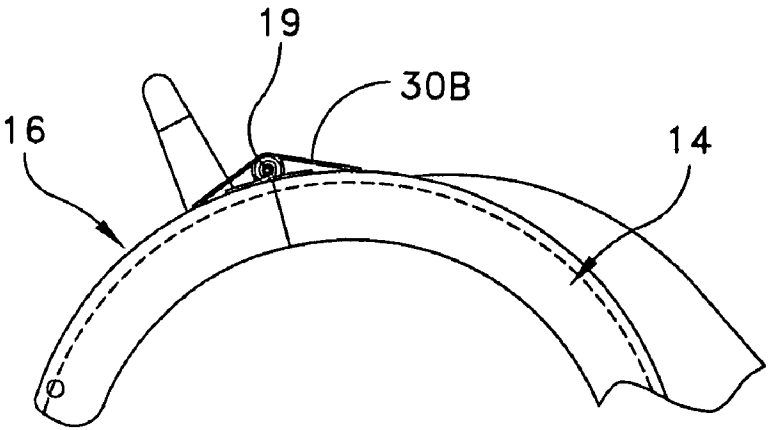
FIG. 10 is a fragmentary view showing still a further embodiment of the biasing means.
Figure 9:
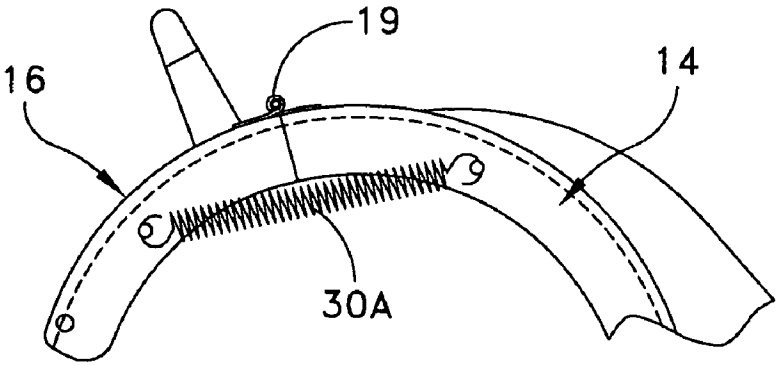
FIG. 9 is a fragmentary view showing an alternate embodiment of the biasing means.
Figure 11:
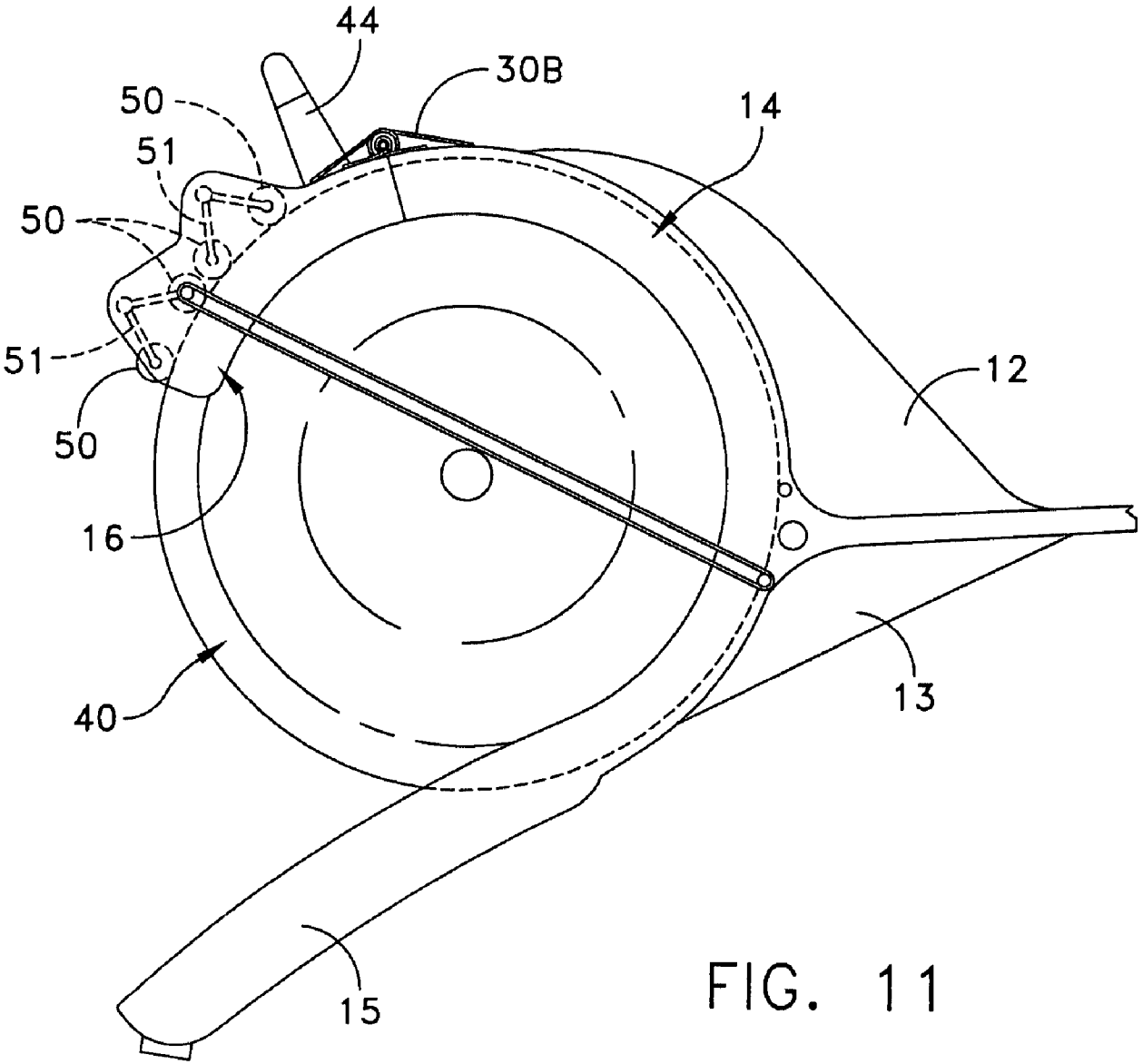
FIG. 11 is a plan view illustrating an alternate embodiment using a pair of pivotal rollers at the distal end of the pivot member.

Reference is now made to FIGS. 9 and 10 for an illustration of alternate biasing means that may be used with the launch device of the present invention. In this connection, FIG. 9 illustrates the use of a coil spring 30A that extends between the curved base 14 and the pivot member 16. Still another embodiment is illustrated in FIG. 10 in the form of a leaf spring 30B supported at the hinge 19 and having ends that engage the respective curved base and pivot member. Reference is now made to FIG. 11 for a slightly different embodiment of the present invention. In FIG. 11 the same reference characters are used to identify like components found in FIGS. 1 and 6. The primary difference with the embodiment of FIG. 11 is that, instead of a single fixed but rotatable roller 26, there are provided one or more pairs of rollers 50 supported on arms 51 and pivotal at a pivot pin 52. The arms 51 are free to pivot on the pin 52. A spring may be associated with the pivot pin 52 to bias the rollers 50 toward the disc 40.

Figure 12:
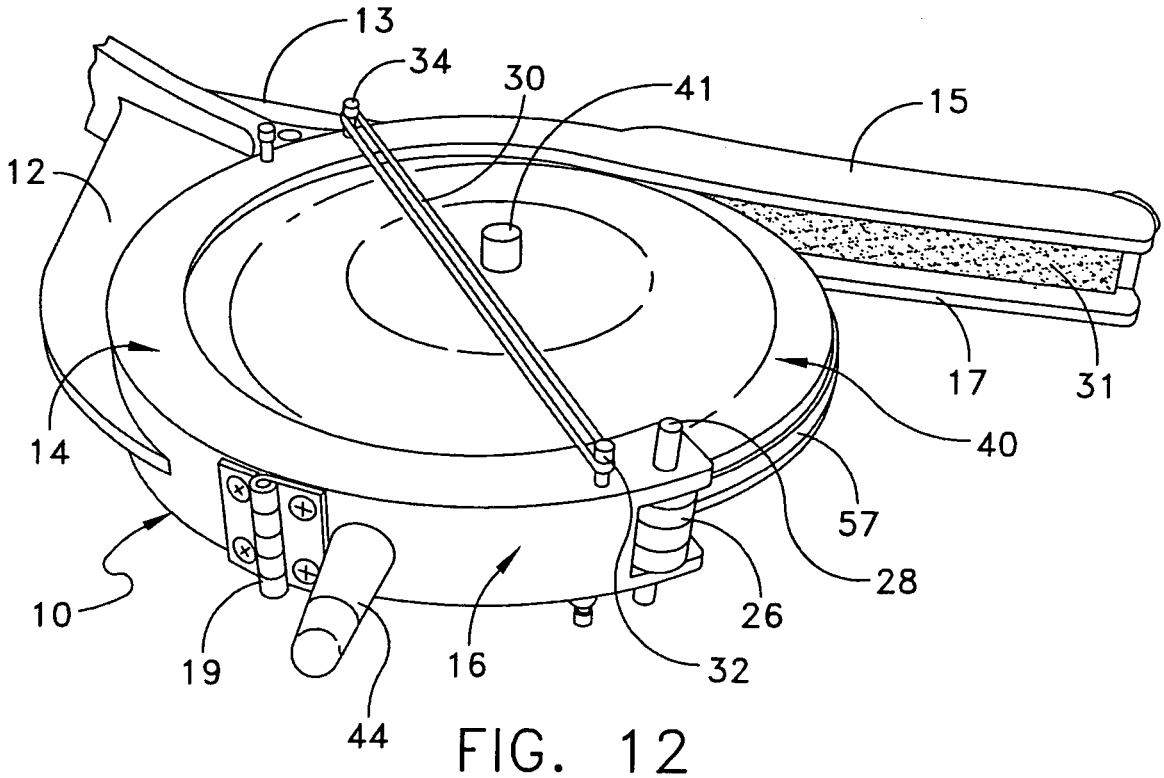
FIG. 12 is a fragmentary perspective view of one embodiment of the disc launching device with the disc in place in the device.
Figure 13:
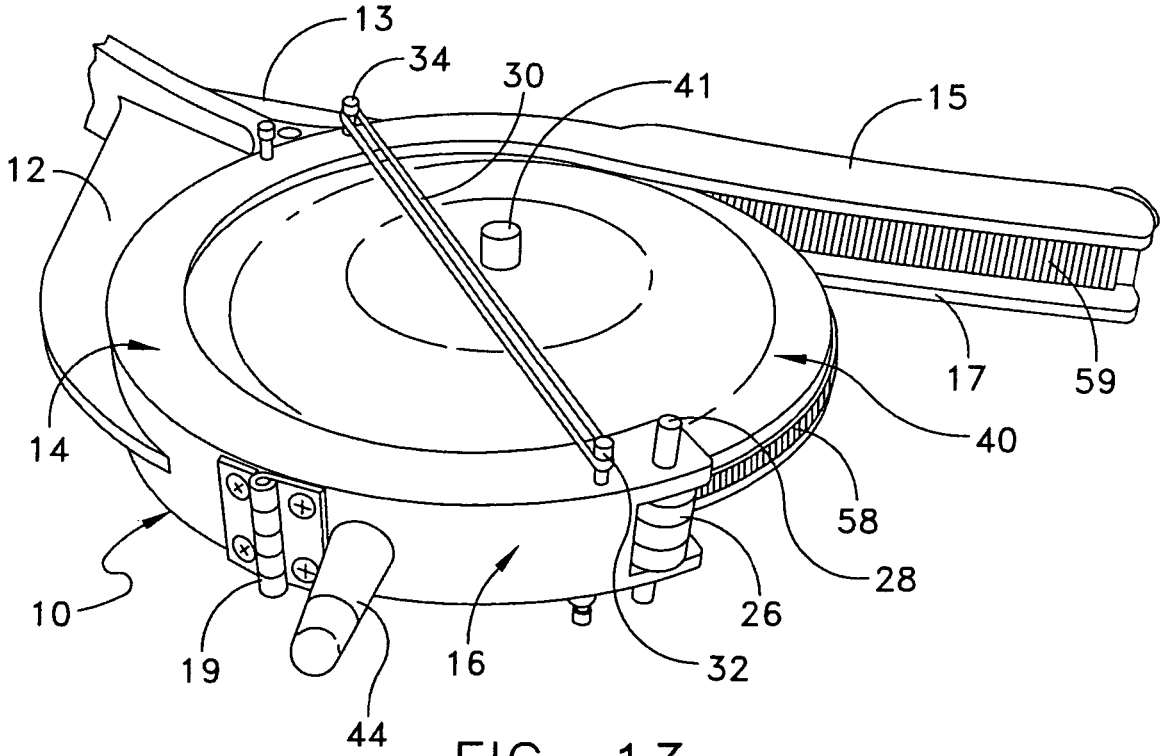
FIG. 13 is a perspective view similar to that shown in FIG. 12 but illustrating a different construction in the holder channel and a different construction of the disc device itself.

Reference is now made to the perspective views of FIGS. 12 and 13 for still further versions of the present invention. In FIG. 12 the disc 40 may be provided with a circumferential rubber like band 57. FIG. 12 also shows the abrasive layer 31 within the channel 17. The arrangement illustrated in FIG. 12 provides a good gripping between the circumferential rubber like layer 57 and the layer 31 within the channel 17 of the extending arm 15. In FIG. 13 the disc 40 is provided with an outer circumferential surface that is provided with a toothed arrangement 58 adapted to engage the tooth surface 59 in the channel 17 of the tangential arm 15. This toothed arrangement in particular, enhances the spinning action of the disc by providing a more firm engagement between the disc and launcher.

Figure 14:
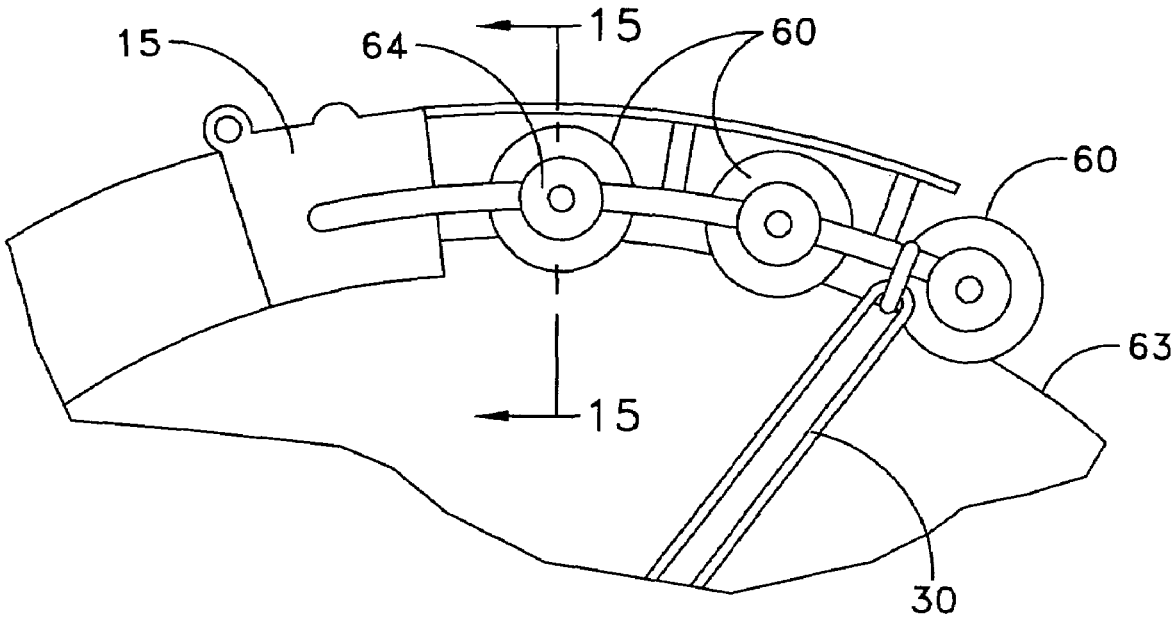
FIG. 14 is a fragmentary view of still a further embodiment of the present invention using multiple distal rollers.
Figure 15:
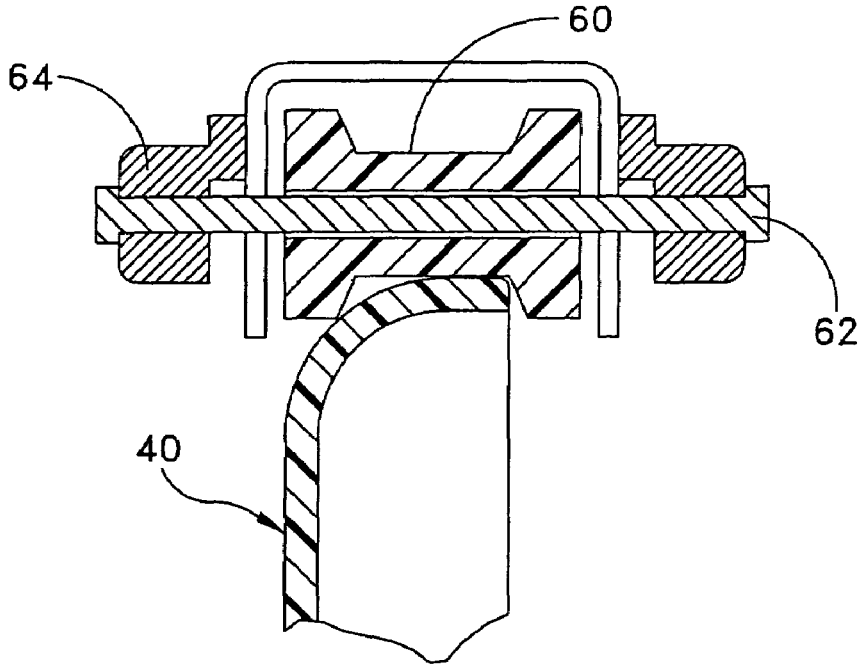
FIG. 15 is a cross-sectional view taken along line 15-15 of FIG. 14.

Reference is now made to FIGS. 14 and 15 for still a further embodiment of the present invention. This embodiment is shown in a fragmentary view to indicate the primary difference between the structure in FIGS. 14 and 15 and that described in, for example, FIG. 1. Rather than a single roller, in FIGS. 14 and 15 a plurality of rollers 60 are employed each supported on a rotational pin 62 as shown in the cross-sectional view of FIG. 15. The rotational pins 62 are supported from side supports 64 that extend from the free end of the arm 15. The biasing band 30 may be attached to one portion along the support 64 as illustrated in FIG. 14. When the disc is propelled, it is assisted by contact with the rollers 60. As shown in FIG. 14, these rollers are disposed along a partially arcuate line 63. The disc being propelled is engaged with the rollers as it is propelled along this line 63.

Figure 16:
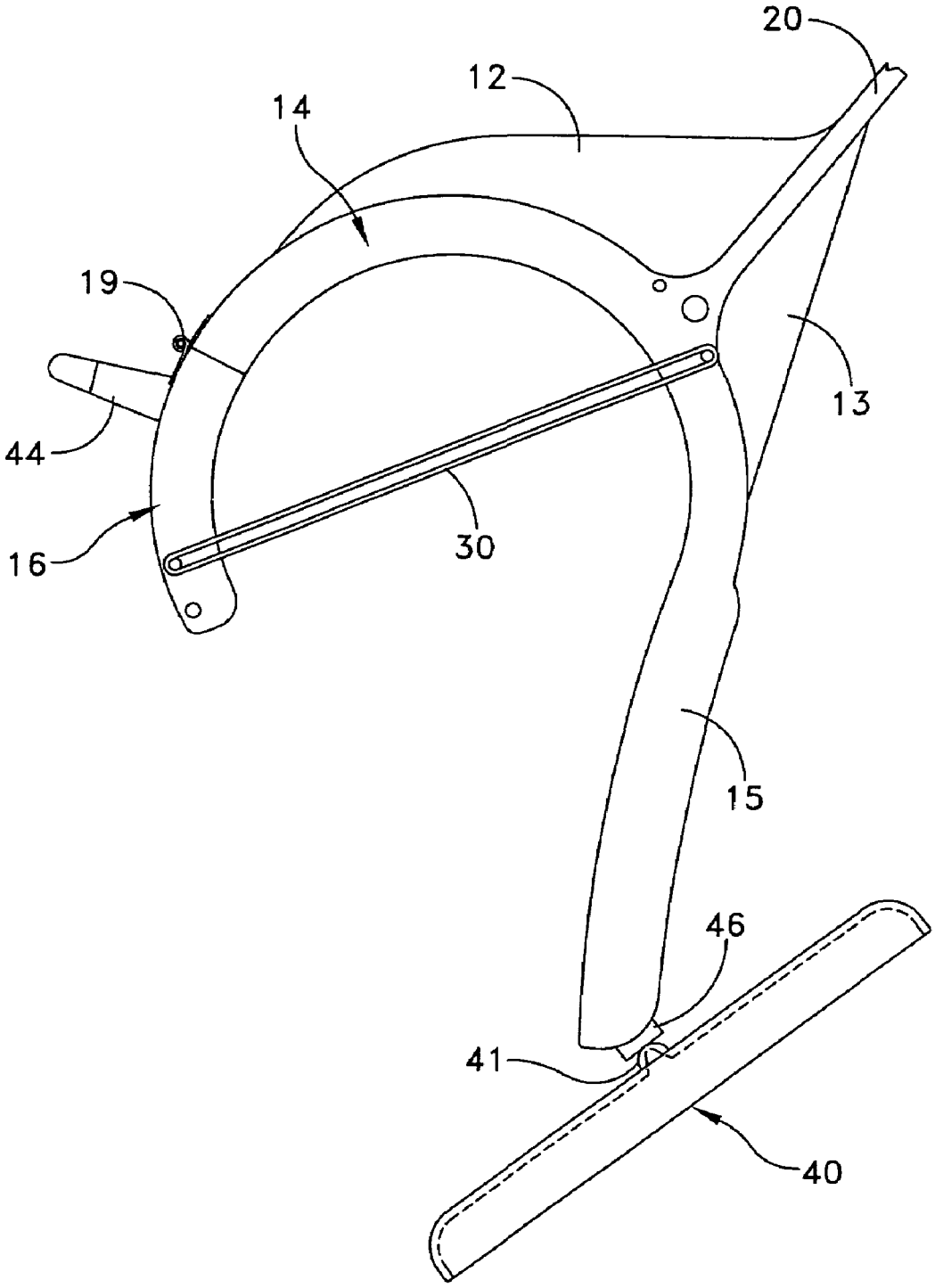
FIG. 16 is an illustration of another embodiment of the invention using magnetic means for picking up the disc or projectile.
Figure 17:
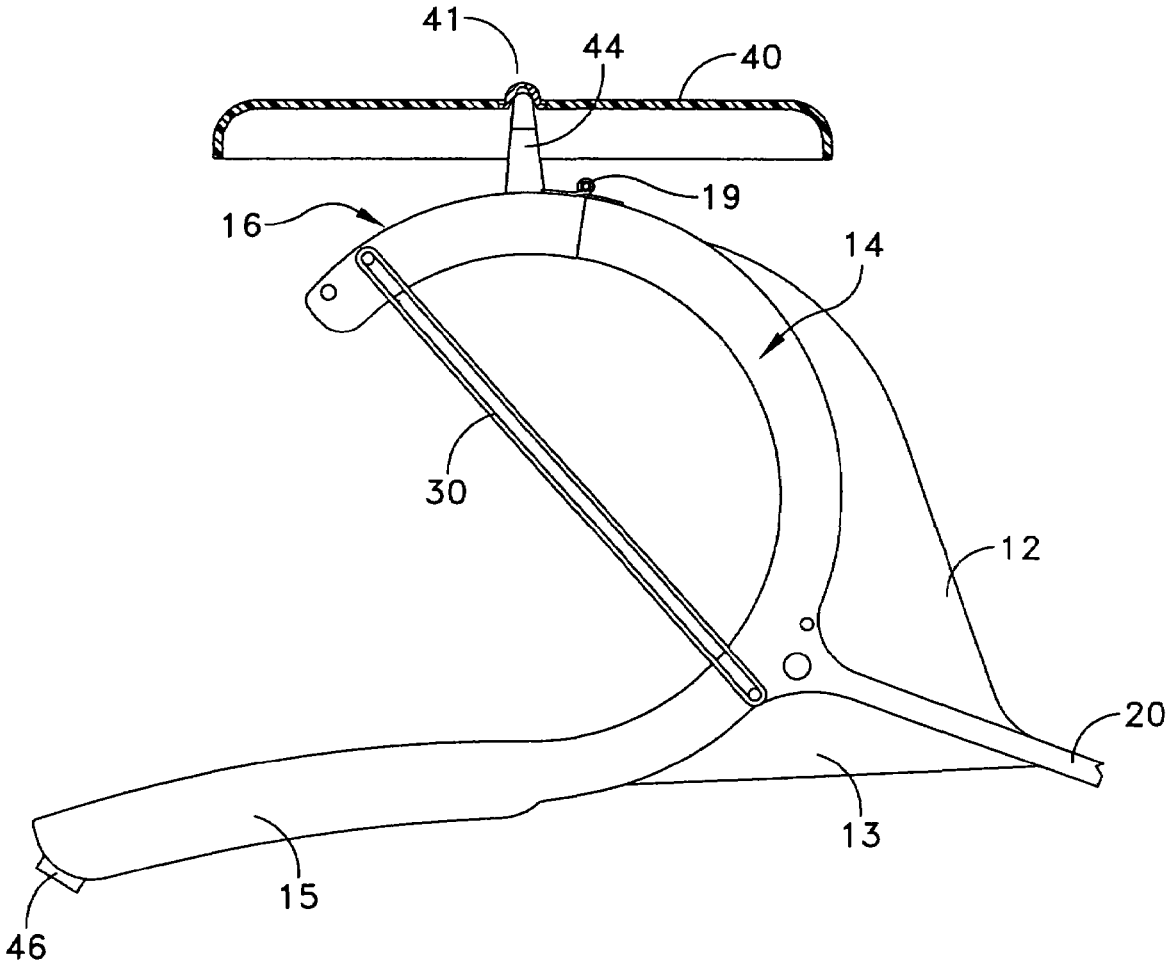
FIG. 17 is a fragmentary view showing the disc launching device of the present invention as used for catching a disc or projectile.

Reference is now made to FIGS. 16 and 17 for an illustration of further features of the present invention. FIG. 16 illustrates the manner in which the launching device of the present invention can be used to pick up a disc from the ground. In FIG. 16 the magnet 46 of the arm 15 is shown engaging the metal tip 41 on the disc 40. FIG. 17 illustrates the manner in which the disc can be caught. Assuming that another player has a like device and has thrown the disc, it can then be caught by the second player in the manner shown in FIG. 17 where the catch post 44 is used by the player to engage under and into the recess at the center of the disc as the disc floats toward the player.

Having now described a limited number of embodiments of the present invention it should be apparent to those skilled in the art that numerous other embodiments and modifications thereof are contemplated as falling within the scope of the present invention, as defined by the appended claims. For example, the launch device of the present invention can be used by a single player for simply launching the disc. The disc can take on the form illustrated in the drawings herein or it can be a standard Frisbee design. Also, the device of the present invention can be constructed with varying radii for the curved base so as to accommodate discs of different diameters. The launching device of the present invention can also be used with multiple players each having one of these devices and adapted to propel the disc from their respective launch device. The player to which the device is thrown can then use their catch post to catch the floating disc. The player can then remove the disc from the catch post and insert it into the launch device in readiness for a subsequent throwing by the receiving player. The game of the present invention can also be readily played with dogs.

What is claimed is:

1. A game device adapted for use by a player to launch a projectile, said device comprising, a holder for receiving the projectile, said holder having a pivot member with a rest position and a released position, means for biasing the pivot member to its rest position so as to at least partially retain the projectile in readiness for launching, and a handle attached to said holder for grasping by the player so as to launch said projectile, the holder comprising an arcuate shaped base for receiving and supporting the projectile, the arcuate shaped base having a free end spaced from the handle, the pivot member including a hinge supported at the free end of the arcuate shaped base.

2. The game device of claim 1 wherein said means for biasing includes a spring extending between said holder and pivot member.

3. The game device of claim 2 wherein said spring comprises a coil spring.

4. The game device of claim 2 wherein said spring comprises a leaf spring.

5. The game device of claim 1 wherein said arcuate shaped base has another end opposite to the free end from which an elongated arm extends.

6. The game device of claim 5 wherein said holder has a channel for receiving said projectile and wherein said channel has a like cross-section matching the peripheral edge of the projectile.

7. The game device of claim 1 wherein said pivot member has a channel forming a track for receiving one of an abrasive material and a gear surface.

8. The game device of claim 1 wherein the arcuate shaped base has another end that is contiguous with a tangentially extending arm.

9. The game device of claim 8 wherein the tangentially extending arm carries a magnet.

10. The game device of claim 1 wherein the arcuate shaped base has another end, the handle being attached to the arcuate shaped base between the ends thereof, the pivot member being also arcuate shaped, and a roller supported at a distal end of the pivot member.

11. The game device of claim 10 wherein the pivot member arcuate shape matches the radius of curvature of the arcuate shaped base.

12. The game device of claim 1 wherein the arcuate shaped base has a radius of curvature that is substantially the same as the radius of curvature of the projectile.

13. A game device adapted for use by a player to launch a projectile, said device comprising, a holder for receiving the projectile, said holder having a pivot member with a rest position and a released position, means for biasing the pivot member to its rest position so as to at least partially retain the projectile in readiness for launching, and a handle attached to said holder for grasping by the player so as to launch said projectile, upon launch said pivot member via engagement with said projectile moving toward said released position to enable launching of said projectile wherein said means for biasing includes at least one resilient band extending between said holder and pivot member.

14. A game device adapted for use by a player to launch a projectile, said device comprising, a holder for receiving the projectile, said holder having a pivot member with a rest position and a released position, means for biasing the pivot member to its rest position so as to at least partially retain the projectile in readiness for launching, and a handle attached to said holder for grasping by the player so as to launch said projectile, upon launch said pivot member via engagement with said projectile moving toward said released position to enable launching of said projectile including a post on one of said holder and pivot member for supporting said projectile.

15. A game device adapted for use by a player to launch a projectile, said device comprising, a holder for receiving the projectile, said holder having a pivot member with a rest position and a released position, means for biasing the pivot member to its rest position so as to at least partially retain the projectile in readiness for launching, and a handle attached to said holder for grasping by the player so as to launch said projectile, upon launch said pivot member via engagement with said projectile moving toward said released position to enable launching of said projectile wherein said projectile has a first magnet means and said device includes a second magnet means to enable the projectile to be picked up by the device.

16. A game device adapted for use by at least one player to throw a projectile, said device comprising, a holder for receiving the projectile and retaining the projectile in an initial position and in readiness for throwing, a handle attached to said holder for grasping by the player so as to launch said projectile, and a receiving post for catching a thrown projectile wherein said holder has a pivot member with a rest position and a released position and means for biasing the pivot member to its rest position so as to at least partially retain the projectile in readiness for throwing.

17. The game device of claim 16 including at least one roller that is rotatably supported at the distal end of said pivot member.

18. A game device adapted for use by at least one player to throw a projectile, said device comprising:

an arcuate shaped base having opposed one and other ends with a uniform radius of curvature between the ends thereof;

a handle attached to the arcuate shaped base at a position between the opposed ends thereof;

an arm that extends tangentially from the one end of the arcuate shaped base;

a pivot member that extends from the other end of the arcuate shaped base and that has respective rest and released positions;

the pivot member also being arcuate shaped;

a hinge that pivotally supports the pivot member from the arcuate shaped base;

means for biasing the pivot member to its rest position so as to at least partially retain the projectile in readiness for launching;

the arcuate shaped base, and the pivot member in the rest position thereof, receiving and supporting the peripheral edge of the projectile;

the radius of curvature of the arcuate shaped base substantially the same as the radius of curvature of the pivot member.

19. The game device of claim 18 wherein the tangentially extending arm carries a magnet.

20. The game device of claim 18 including at least one roller supported at a distal end of the pivot member.

21. The game device of claim 18 wherein the arcuate shaped base and the pivot member both have a radius of curvature that is substantially the same as the radius of curvature of the projectile.

22. The game device of claim 18 wherein said means for biasing comprises at least one elastic band that extends from said arcuate shaped base.

23. The game device of claim 22 wherein said at least one elastic band extends between the arcuate shaped base and the pivot member.

24. The game device of claim 23 including a pair of elastic bands.

25. The game device of claim 24 wherein one elastic band is disposed on one side of the device and the other elastic band is disposed on the other side of the device.

* * * * *